US005143807A

United States Patent [19]

Yoshizawa et al.

[11] Patent Number: 5,143,807

[45] Date of Patent: Sep. 1, 1992

[54] ELECTROPHOTOGRAPHIC PHOTORECEPTOR WITH SUPERLATTIC BARRIER LAYER

[75] Inventors: Shuji Yoshizawa; Tatsuya Ikezue, both of Tokyo, Japan

[73] Assignee: Kabushiki Kaisha Toshiba, Kawasaki, Japan

[21] Appl. No.: 408,384

[22] Filed: Sep. 18, 1989

Related U.S. Application Data

[63] Continuation of Ser. No. 124,272, Nov. 24, 1987, abandoned.

[30] Foreign Application Priority Data

| | | | |
|---|---|---|---|
| Nov. 29, 1986 | [JP] | Japan | 61-284595 |
| Nov. 29, 1986 | [JP] | Japan | 61-284596 |
| Nov. 29, 1986 | [JP] | Japan | 61-284597 |
| Dec. 26, 1986 | [JP] | Japan | 61-315562 |
| Dec. 26, 1986 | [JP] | Japan | 61-315570 |
| Dec. 26, 1986 | [JP] | Japan | 61-315572 |

[51] Int. Cl.[5] ..... G03G 5/082; G03G 5/14

[52] U.S. Cl. ..... 430/65; 430/57

[58] Field of Search ..... 430/57, 60, 65

[56] References Cited

U.S. PATENT DOCUMENTS

| | | | |
|---|---|---|---|
| 4,557,987 | 12/1985 | Shirai et al. | 430/65 X |
| 4,672,015 | 6/1987 | Manuyama et al. | 430/57 |
| 4,677,044 | 6/1987 | Yamazaki | 430/58 |
| 4,683,184 | 7/1987 | Osawa et al. | 430/57 |
| 4,701,395 | 10/1987 | Wronski | 430/57 X |
| 4,718,947 | 1/1988 | Arya | 136/258 |
| 4,720,444 | 1/1988 | Chen | 430/86 X |
| 4,722,879 | 2/1988 | Neno et al. | 430/57 |
| 4,729,937 | 3/1988 | Yamazaki | 430/65 |
| 4,780,384 | 10/1988 | Saitoh | 430/57 |

*Primary Examiner*—Roland Martin
*Attorney, Agent, or Firm*—Foley & Lardner

[57] ABSTRACT

An electrophotographic photoreceptor is disclosed which is constituted by a conductive substrate, a barrier layer formed thereon, and a photoconductive layer, formed on the barrier layer, for generating photocarriers upon radiation of light. A portion of the barrier layer is formed by alternately stacking first thin films consisting of amorphous or microcrystalline silicon containing an element which controls a conductivity type and second thin films, these having a band gap wider than that of the first thin film. A multilayered structure made up of the first and second thin films has a superlattice structure.

1 Claim, 3 Drawing Sheets

ELECTROPHOTOGRAPHIC PHOTORECEPTOR WITH SUPERLATTIC BARRIER LAYER

This application is a continuation of application Ser. No. 07/124,272, filed Nov. 24, 1987, now abandoned.

BACKGROUND OF THE INVENTION

The present invention relates to an electrophotographic photoreceptor for use in electrophotography.

Amorphous silicon containing hydrogen H (to hereinafter be referred to as a-Si:H) has received a great deal of attention as a photoconductive material, and has been used in a variety of applications, such as solar cells, thin film transistors, image sensors, and electrophotographic photoreceptors.

Materials used as photoconductive layers in conventional electrophotographic photoreceptors can be categorized as either inorganic (e.g., CdS, ZnO, Se, or Se-Te) or organic (poly-N-vinylcarbazole (PVCZ) or trinitrofluorene). The a-Si:H photoconductive material has many advantages over the above-mentioned conventional organic and inorganic materials, such as that it is non-toxic and does not require recovery, high spectral sensitivity in the range of visible light is effected, and its high surface hardness ensures high resistance to wear and good anti-impact properties. It is for these reasons that a-Si:H is receiving a great deal of attention as a promising electrophotographic photoreceptor.

The a-Si:H material has been developed as an electrophotographic photoreceptor on the basis of the Carlson system. In this case, good photoreceptor properties mean high dark resistance and high sensitivity to light. However, since it is difficult to incorporate these two properties in a signal layer photoreceptor, a barrier layer is therefore arranged between the photoconductive layer and a conductive support, with a surface charge-retaining layer being formed on the photoconductive layer, to constitute a multilayer structure, and thereby satisfy the two requirements described above.

As a conventional barrier layer, an insulating single layer having a high resistance is used. However, if such an insulating layer is quite thick, carriers flowing from the photoconductive layer to the conductive substrate cannot pass through the barrier layer. As a result, the residual potential is increased. If, on the other hand, the barrier layer is not so thick, the layer then causes insulating breakdown to occur, due to a developing bias applied to the photoreceptor. When the barrier layer employs a p- or n-type semiconductor, if the layer has a large thickness, the carriers are trapped in structural defects such as dangling bonds and a residual potential is increased. Also, if the layer is not so thick, the carriers from the conductive substrate cannot be blocked, with the result that the charging capacity is decreased.

For use in a two-color copying machine or in a machine used as both a printer and a copying machine, a photoreceptor is required which can be charged in both positive and negative polarities. When such a photoreceptor is formed using a-Si, oxygen may be added thereto or an insulating layer may be formed between a photoconductive layer and a conductive substrate. However, in the former case, the number of defects in the film will be increased due to addition of oxygen, thus degrading the sensitivity and residual potential. In the latter case, if the insulating layer is quite thick, carriers become trapped, and the residual potential is undesirably increased. If, on the other hand, the insulating layer is not so thick, the barrier layer causes insulating breakdown to occur, due to a developing bias applied to the photoreceptor.

SUMMARY OF THE INVENTION

It is an object of the present invention to provide an electrophotographic photoreceptor which has good charge retaining properties, low residual potential, high sensitivity over a wide wavelength range from a visible range to a near-infrared range, good bonding properties between a conductive substrate and a barrier layer, and excellent environmental resistance.

According to a first embodiment of the present invention, there is provided an electrophotographic photoreceptor comprising a conductive substrate, a barrier layer formed thereon, and a photoconductive layer for generating photocarriers upon radiation of light, wherein the barrier layer has a portion formed by alternately stacking first thin films, each consisting of amorphous or microcrystalline silicon containing an element which controls a conductivity type, and second thin films, each having a band gap wider than that of the first thin film.

In the first embodiment, the conductivity type control element contained in the first thin film comprises an element belonging to Group III or V of the Periodic Table. Examples of the element belonging to Group III of the Periodic Table include boron (B), aluminum (Al), gallium (Ga), indium (In), and thallium (Tl). Examples of the element belonging to Group V of the Periodic Table include nitrogen (N), phosphorus (P), arsenic (As), antimony (Sb), and bismuth (Bi).

The content of the conductivity type control element contained in the first thin film is preferably $10^{-6}$ to 1 atomic %, and more preferably $10^{-4}$ to $10^{-2}$ atomic %.

The second thin film, having a band gap wider than that of the first thin film, can adopt a semiconductor thin film containing boron and nitrogen as major components. If the first thin film is formed of amorphous silicon, the second thin film can consist of amorphous silicon containing at least one of carbon, oxygen, and nitrogen. The content of carbon, oxygen, or nitrogen is preferably 0.1 to 20 atomic %, and more preferably, 0.5 to 20 atomic %.

Microcrystalline silicon (μc-Si) is thought to be formed by a mixture phase of amorphous silicon and microcrystalline silicon having a particle diameter of several tens of angstroms and has the following physical properties:

First, microcrystalline silicon has a diffraction pattern for 2 of 28 to 28.5° according to X-ray diffractiometry, and can be clearly distinguished from amorphous Si causing only a halo.

Second, the dark resistance of μc-Si can be adjusted to $10^{10}$ Ω.cm or more, and can be clearly distinguished from polycrystalline silicon having a dark resistance of $10^5$ Ω.cm.

The optical band gap (Eg) of μc-Si used in the present invention can be set arbitrarily to fall within a predetermined range, being preferably 1.55 eV, for example. In this case, in order to obtain a desirable Eg°, hydrogen is preferably added to obtain μc-Si:H.

According to a second embodiment of the present invention, there is provided an electrophotographic photoreceptor capable of being charged in both positive and negative polarities, comprising a conductive substrate, a barrier layer formed thereon, and a photoconductive layer for generating photocarriers upon radiation of light, wherein the barrier layer has a portion formed by alternately stacking first thin films and second thin films, the latter having a band gap different from that of the first thin film.

In the second embodiment, the first thin film can comprise a-Si, and the second thin film, having a band gap different from that of the second thin film, can comprise a-Si containing hydrogen and at least one element selected from the group consisting of carbon, oxygen, nitrogen, and germanium. Note that instead of a-Si, a-SiGe, a-Ge, a-GeN, a-GeC, a-GeO, or the like may be used. The difference between the respective band gaps of adjacent first and second thin films is preferably 0.5 to 3 eV, and more preferably 1 to 1.5 eV.

Semiconductor films having different dark resistances may be employed as the first and second thin films having different respective band gaps. Such semiconductor films can correspond directly to those described above as the first and second thin films having different respective band gaps. Note that the difference in dark resistances between adjacent first and second thin films is preferably $10^2$ to $10^5$ Ω.cm.

A combination of an insulating semiconductor film and a photoconductive semiconductor film may be employed as the first and second thin films having different band gaps, respectively. Examples of the insulating semiconductor film include an a-Si layer, a μc-Si layer, and the like. Examples of the photoconductive semiconductor film include an a-Si layer containing at least one element selected from the group consisting of carbon, oxygen, and nitrogen, a-BN layer, and the like.

The content of carbon, oxygen, or nitrogen in the a-Si layer is preferably 0.1 to 20 atomic %, and more preferably, 0.5 to 20 atomic %.

In the electrophotographic photoreceptor of the present invention described above, the thickness of each of the first and second thin films constituting the barrier layer is preferably 30 to 500 Å.

In the electrophotographic photoreceptor according to the present invention, the content of hydrogen in a-Si:H and μc-Si:H is preferably 0.01 to 30 atomic %, and more preferably 1 to 25 atomic %. This amount of hydrogen compensates for dangling bonds of silicon, and provides a good balance between the dark resistance and the bright resistance, thereby improving the photoconductive property.

An a-Si:H layer can be formed through a silane series gas, such as $SiH_4$ or $Si_2H_4$ as a raw or source gas, being supplied to a reaction chamber, with high-frequency power being supplied to the raw gas to cause glow discharge. In this case, hydrogen or helium gas as a carrier, as needed. The source gas is, however, not limited to a silane series gas, but can be replaced by a silicon halide gas (e.g., $SiF_4$ or $SiCl_4$) or a mixture of a silane series gas and a silicon halide gas. The a-Si:H layer can be formed not only by the glow discharge method but also by a physical method such as sputtering.

A μc-Si layer can be formed by the high-frequency glow discharge method, using silane gas as a raw gas, in the same manner as in the a-Si:H layer. In this case, if the film formation temperature is higher than that of the a-Si:H layer, and the high-frequency power for the μc-Si layer is also higher than that of the a-Si:H layer, a μc-Si:H layer is easily formed. Furthermore, when a higher substrate temperature and a higher high-frequency power are used, the flow rate of the raw gas, such as silane gas, can be increased, resulting in an increased film formation rate. Furthermore, when use is made of a gas prepared by diluting a silane gas of a higher order (e.g., $SiH_4$ or $Si_2H_6$) with hydrogen, a μc-Si:H layer can be formed with greater efficiency.

As is described above, at least part of the barrier layer of the electrophotographic photoreceptor is constituted by the plurality of stacked thin layers having different optical band gaps. In this manner, since the thin layers having different optical band gaps are stacked, a superlattice structure can be obtained such that a layer having a larger optical band gap serves as a barrier with respect to a layer having a small optical band gap, irrespective of the absolute magnitudes of the optical band gaps, so as to constitute a periodic potential barrier pattern. In the case of the superlattice structure, since the layers constituting the barrier are very thin, carriers can easily pass through the barrier and move in the superlattice structure by virtue of the tunnel effect of the carriers in the thin layers. In addition, a large number of carriers are generated in such a superlattice structure, and have a long lifetime and high mobility. For these reasons, the sensitivity of the electrophotographic photoreceptor can be greatly improved, through the precise mechanism responsible for this improvement cannot be precisely clarified. Nevertheless, the improvement may be regarded as a quantum effect due to a periodic well type potential unique for the superlattice structure. This effect is commonly referred to as a superlattice effect.

By changing the band gap and the thickness of the thin layer in the superlattice structure, the apparent band gap can be arbitrarily adjusted.

DETAILED DESCRIPTION OF THE PREFERRED EMBODIMENTS

Various embodiments of the present invention will now be described in detail, with reference to the accompanying drawings.

Figure 1:
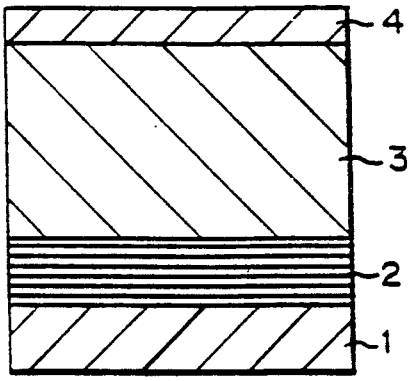
FIG. 1 is a sectional view of an electrophotographic photoreceptor according to one embodiment of the present invention.

FIG. 1 is a sectional view of an electrophotographic photoreceptor according to one embodiment of the present invention.

In the electrophotographic photoreceptor shown in FIG. 1, barrier layer 2 is formed on conductive substrate 1, photoconductive layer 3 is formed on barrier layer 2, and surface layer 4 is formed on photoconductive layer 3.

Figure 2:
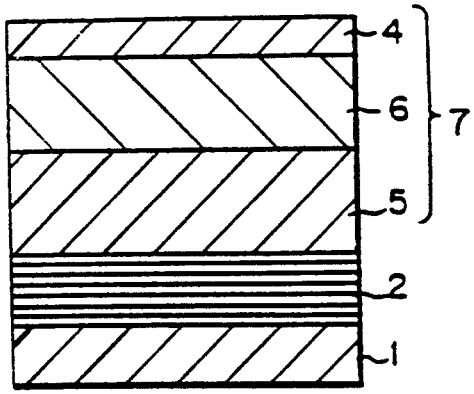
FIG. 2 is a sectional view of an electrophotographic photoreceptor according to another embodiment of the present invention.

FIG. 2 is a sectional view of an another embodiment of the present invention.

In the electrophotographic photoreceptor shown in FIG. 2, use is made of function separating type photoconductive layer 7 which comprises charge-transporting layer 5 and charge-generating layer 6. More specifically, charge-transporting layer 5 is formed on barrier layer 2, with charge-generating layer 6 being formed on charge-transporting layer 5. In addition, surface layer 4 is formed on charge-generating layer 6.

A detailed description of the parts used in the embodiment shown in FIGS. 1 and 2 now follows.

Conductive substrate 1 is normally an aluminum drum.

Figure 3:
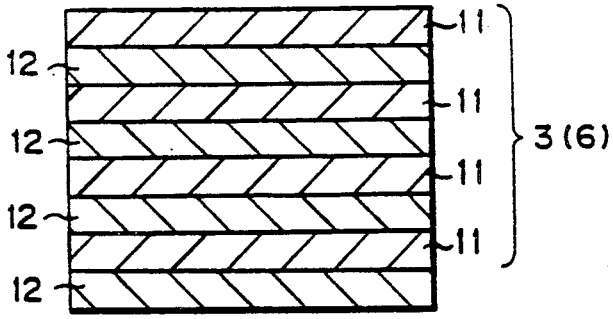
FIG. 3 is a sectional view showing part of FIGS. 1 and 2 in an enlarged scale.

Referring to FIG. 3, it can be seen that barrier layer 2 has a superlattice structure which results from alternately stacking first and second thin layers 11 and 12 having different optical band gaps, respectively.

Figure 4:
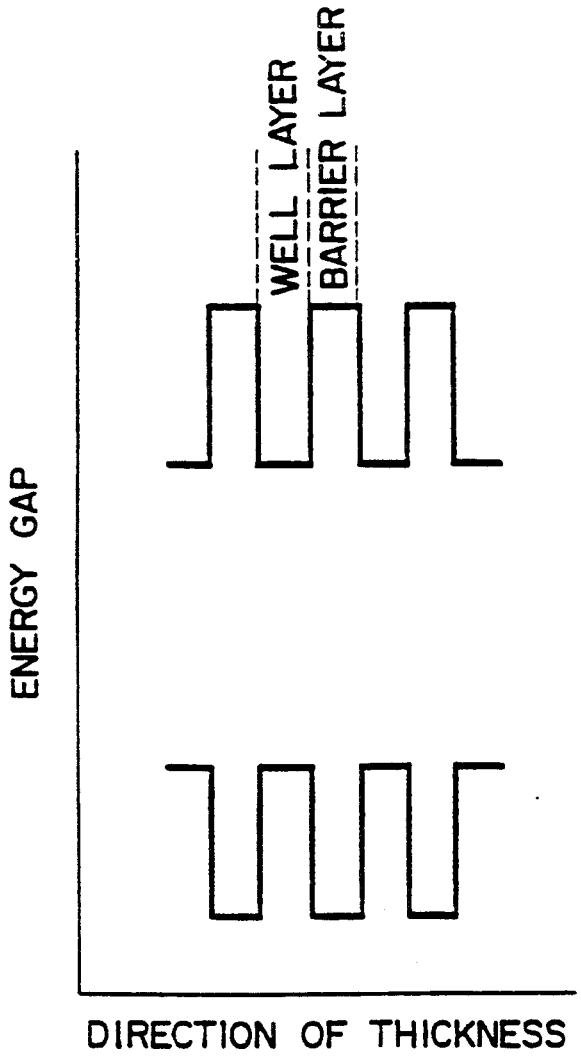
FIG. 4 is a view respectively showing an energy band of the superlattice structure.

FIG. 4 is a graph showing the energy band of the superlattice structure, in which the direction of thickness is plotted along the ordinate, and the optical band gap is plotted along the abscissa.

Barrier layer 2 restricts the flow of charge between conductive substrate 1 and photoconductive layer 3 (or charge-generating layer 6), so as to improve the charge-retaining capacity on the surface of the photoconductive layer and to improve the charging capacity of the layer. Thus, when a Carlson photoreceptor is manufactured using a semiconductor layer as a barrier layer, barrier layer 2 must be of a p or n conductivity type so as not to degrade the charge-retaining capacity of the surface. More specifically, in order to positively charge the surface of the photoreceptor, p-type barrier layer 2 is formed to prevent injection of electrons for neutralizing the surface charge into the photoconductive layer. However, in order to negatively charge the surface, n-type barrier layer 2 is formed to prevent injection of holes for neutralizing the surface charge into the photoconductive layer. Carriers injected from barrier layer 2 serve as noise for carriers generated in photoconductive layers 3 and 6 upon irradiation of light. By preventing the injection of carriers as described above, the sensitivity of the photoconductive layers can be improved. In order to obtain p-type μc-Si:H or p-type a-Si:H, elements belonging to Group III of the Periodic Table, such as boron (B), aluminum (Al), gallium (Ga), indium (In), and thallium (T1) are preferably doped in μc-Si:H or a-Si:H. In order to obtain n-type μc-Si:H or n-type a-Si:H, elements belonging to Group V of the Periodic Table, such as nitrogen (N), phosphorus (P), arsenic (As), antimony (Sb), and bismuth (Bi) are preferably doped in μc-Si:H or a-Si:H.

In the electrophotographic photoreceptor shown in FIG. 1, photoconductive layer 3 generates carriers upon reception of incident light. The carriers having one polarity are neutralized with the charge on the surface of the photoreceptor, while those having the other polarity are moved through photoconductive layer 3 up to conductive substrate 1. In the function separating type photoreceptor shown in FIG. 2, carriers are generated by charge-generating layer 6 upon incidence of light. The 15 carriers having one polarity travel through charge-transporting layer 5 and reach conductive substrate 1.

Surface layer 4 is formed on photoconductive layer 3 or on charge-generating layer 6. The refractive index of μc-Si:H or a-Si:H constituting photoconductive layer 3 or charge-generating layer 6 is as relatively large as 3 to 3.4, with the result that reflection tends to occur on the surface of the layer. When such reflection occurs, the amount of light absorbed in the photoconductive layer or the charge-generating layer decreases, and optical loss typically occurs. For this reason, surface layer 4 is preferably formed such that light reflection is prevented. In addition, surface layer 4 protects photoconductive layer 3 or charge-generating layer 6 against being damaged, brings about an improvement in the charging capacity, and its surface can be satisfactorily charged. A suitable material for forming the surface layer is an inorganic compound such as a-SiN:H, a-SiO:H, or a-SiC:H, or an organic material such as polyvinyl chloride or polyamide).

When the surface of the electrophotographic photoreceptor is positively charged by corona discharge with a voltage of about 500 V, and light (hν) is incident on the photoconductive layer, carriers, i.e., electrons and holes, are generated in photoconductive layer 3. The electrons in the conduction band are accelerated toward surface layer 4 by an electric field in the photoreceptor, while the holes are accelerated toward conductive substrate 1.

In this case, if a conventional barrier layer comprising an insulating single layer having a high resistance, is relatively thick, carriers flowing from the photoconductive layer to the conductive substrate cannot pass through the barrier layer, and as a result, the residual potential is undesirably increased. On the other hand, if it is relatively thin, the barrier layer causes insulating breakdown due to the developing bias applied to the photoreceptor. When a p- or n-type semiconductor is used as the barrier layer, and is relatively thick, the carriers become trapped by structural defects such as dangling bonds, and hence, the residual potential is increased. On the other hand, if the barrier layer is relatively thin, the carriers from the conductive substrate then cannot be blocked, with the result that the charging capacity is degraded.

In contrast to this, in the present invention, if the barrier layer comprises the superlattice structure, in the potential well layer, due to the quantum effect, the carrier lifetime is 5 to 10 times that of a single layer which is not a superlattice structure. In addition, in the superlattice structure, discontinuity of the band gaps forms periodic barriers. However, the carriers can easily pass through the bias layer by virtue of the tunnel effect, so that effective mobility of the carriers is substantially the same as that in the bulk, thus achieving high-speed carrier movement. As is described above, according to the electrophotographic photoreceptor having the barrier layer of the superlattice structure wherein thin layers having different optical band gaps are stacked, a good photoconductive property can be obtained, and therefore a clearer image can be obtained as compared with a conventional photoreceptor.

The electrophotographic photoreceptor having the superlattice structure described above does not suffer from degradation as regards the mobility or lifetime of the carriers, even if the thickness of the barrier layer is increased, and has both good positive and negative charging properties.

Figure 5:
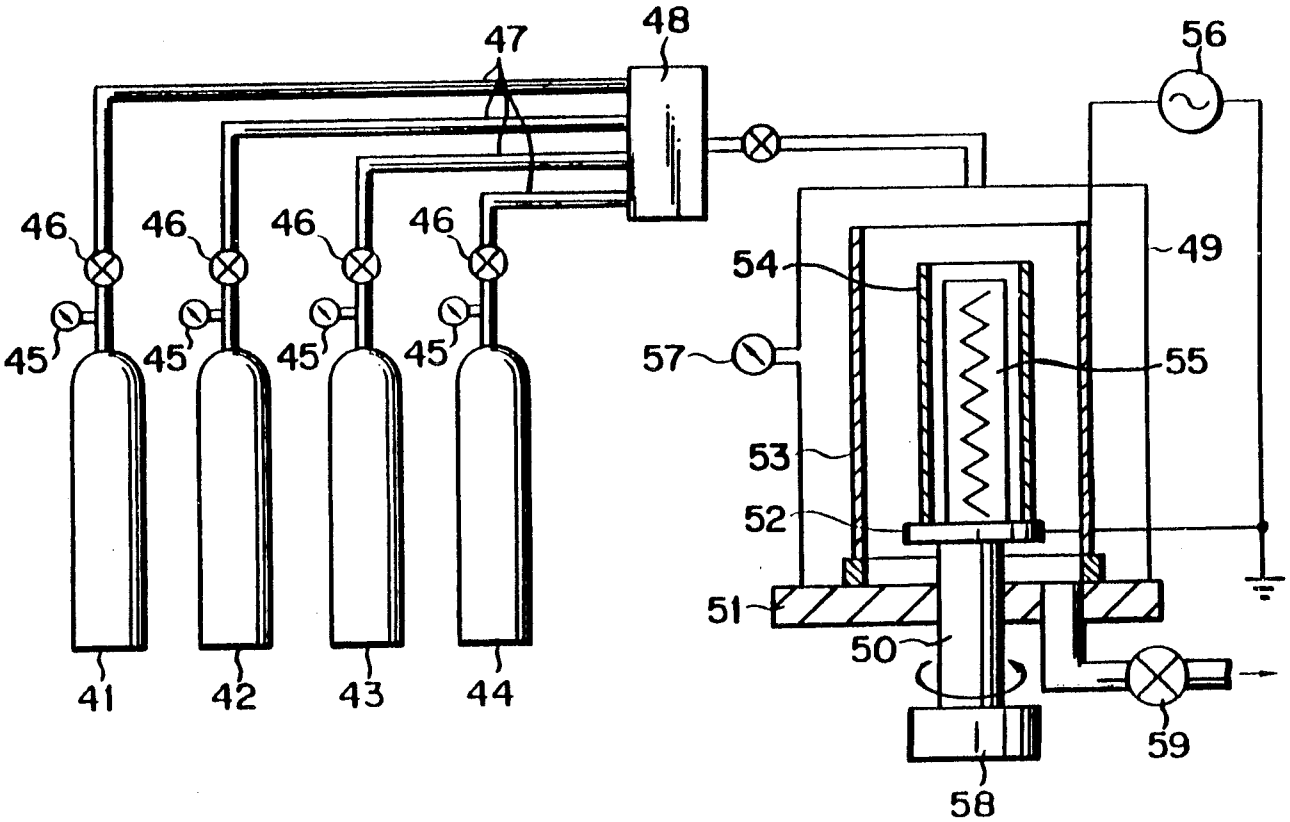
FIG. 5 is a view of an apparatus for manufacturing an electrophotographic photoreceptor of the present invention.

FIG. 5 shows an apparatus for manufacturing an electrophotographic photoreceptor according to the present invention, utilizing the glow discharge method. Gas cylinders 41, 42, 43, and 44 store source gases such as $SiH_4$, $B_2H_6$, $H_2$, and $CH_4$, respectively. These gases can be supplied to mixer 48, through flow control valves 46 and pipes 47. Each cylinder has a pressure gauge 45 which the operator manitors while controlling its corresponding valve 46, thereby to control the flow rate of each of the gases, as well as their respective mixing ratios. The gas mixture is then supplied from mixer 48 to reaction chamber 49.

Rotating shaft 10 extends vertically from bottom 11 of reaction chamber 49, and can be rotated about the vertical axis. Disk-like support table 52 is fixed on the upper end of shaft 50 such that the surface of table 52 is perpendicular to shaft 50. Cylindrical electrode 53 is arranged inside chamber 49 such that the axis of electrode 53 is aligned with the axis of shaft 50. Drum-like substrate 54 for a photoreceptor is placed on table 52 such that its axis is aligned with that of shaft 50. Drum-like substrate heater 55 is arranged inside substrate 54. RF power source 56 is connected between electrode 53 and substrate 54, and supplies an RF current therebetween. Rotating shaft 50 is driven by motor 58. The internal pressure of reaction chamber 49 is monitored by pressure gauge 57, chamber 49 being connected to a suitable evacuating means, such as a vacuum pump, via gate valve 58.

In order to manufacture a photoreceptor in the apparatus having the construction described above, drum-like substrate 14 is placed in reaction chamber 49, and gate valve 59 is opened to evacuate chamber 49 to a vacuum of about 0.1 Torr or less. The predetermined gases from cylinders 41, 42, 43, and 44 are supplied to chamber 49, at a predetermined mixing ratio. In this case, the flow rates of the gases supplied to chamber 49 are determined such that the internal pressure of chamber 49 is set to be 0.1 to 1 Torr. Motor 58 is operated to rotate substrate 54. Substrate 54 is heated to a predetermined temperature by heater 55, and an RF current is supplied between electrode 53 and substrate 14, thereby generating a glow discharge therebetween. An a-Si:H layer is deposited on substrate 54. $N_2O$, $NH_3$, $NO_2$, $N_2$, $CH_4$, $C_2H_4$, and $O_2$ gases and the like may be added to the feed gas to add the element N, C, or O in the a-Si:H layer.

As is apparent from the above description, the electrophotographic photoreceptor according to the present invention can be manufactured in a closed-system manufacturing apparatus, thus guaranteeing the safety of the operators. Since the electrophotographic photoreceptor has high resistance to heat, to humidity, and to wear, repeated used thereof does not result in degradation; thus, a long service life is assured.

Electrophotographic photoreceptors according to the present invention were formed, and their electrophotographic characteristics were tested in the following manner.

EXAMPLE 1

An aluminum drum substrate having a diameter of 80 mm and a length of 350 mm and subjected to acid, alkali, and sandblast treatments as needed to prevent interference, was mounted in a reaction chamber, and the interior of the reaction chamber was exhausted by a diffusion pump (not shown) to obtain a vacuum pressure of about $10^{-5}$ Torr. Thereafter, the drum substrate was heated to a temperature of 250° C. and rotated at 10 rpm, and an $SiH_4$ gas with a flow rate of 500 SCCM, a $B_2H_6$ gas with a ratio of flow rate of $10^{-3}$ with respect to the $SiH_4$ gas were supplied into the reaction chamber, and the interior of the reaction chamber was adjusted to be 1 Torr. A high-frequency power 13.56 MHz was applied to generate a plasma, and a 50-Å thick p-type a-Si:H thin layer was formed on the drum substrate. Then, supply of the $B_2H_6$ gas was stopped, and a $CH_4$ gas with a flow rate of 100 SCCM was supplied, thereby forming 50-Å a-SiC:H thin layer. The above operation was repeated, and a barrier layer having a 5,000-Å superlattice structure constituted by 50 p-type a-Si:H layers and 50 a-SiC:H layers was formed.

A $B_2H_6$ gas was supplied into the reaction chamber to have a ratio of flow rate of $10^{-6}$ with respect to the $SiH_4$ gas, and the interior of the reaction chamber was adjusted to be 1 Torr. Then, a high-frequency power of 300 W was applied to form a 15-μm thick i-type a-Si:H photoconductive layer.

Finally, a 0.5-μm thick a-SiC:H surface layer was formed.

The surface of the electrophotographic photoreceptor formed in this manner was positively charged at a voltage of about 500 V, and was exposed with white light. The white light was absorbed by the charge-generating layer, and carriers of electron-hole pairs were generated. In Example 1, a large number of carriers were generated, a lifetime of the carriers was long, and a good carrier mobility was obtained. Thus, a clear, high-quality image was obtained. When the electrophotographic photoreceptor manufactured in this example was repeatedly charged, reproducibility and stability of a transferred image were very good, and high resistance to corona, to humidity, and to wear was demonstrated.

EXAMPLE 2

An electrophotographic photoreceptor was manufactured following the same procedures as in Example 1 except that an i-type μc-Si layer was formed instead of the i-type a-Si:H layer. Note that the i-type μc-Si layer was obtained in such a manner that an $SiH_4$ gas with a flow rate of 100 SCCM and an $H_2$ gas with a flow rate of 1,200 SCCM were supplied into a reaction chamber, and a pressure inside the reaction chamber was set to be 1.2 Torr, and a high-frequency power of 1 kW was applied thereto.

The photoreceptor manufactured in this manner had high sensitivity with respect to light having a long wavelength of 780 to 790 nm corresponding to an oscillation wavelength of the semiconductor laser. The photoreceptor was mounted on a semiconductor laser printer, and an image was formed by the Carlson process. As a result, even if a light amount exposed to the photoreceptor surface was 25 ergcm$^2$, a clear, high-resolution image could be obtained.

When the photoreceptor was repeatedly charged, the reproducibility and stability of a transferred image were high, and resistance to corona, to humidity, and to wear was good.

EXAMPLE 3

After a 50-Å p-type a-Si:H thin layer was formed on a drum substrate following the same procedures as in Example 1, an $SiH_4$ gas with a flow rate of 500 SCCM and an $N_2$ gas with a flow rate of 150 SCCM were supplied into a reaction chamber, and a pressure of the interior of the reaction chamber was adjusted to be 1 Torr. Thereafter, a high-frequency power of 400 W was applied, thus forming a 50-A a-Si:H thin layer. Upon repetition of the above operation, a 1-μm barrier layer having a superlattice structure constituted by 100 p-type a-Si:H layers and 100 a-SiN:H layers was formed. Thereafter, following the same procedures as in Example 1, a photoconductive layer and a surface layer were formed.

The photoreceptor manufactured in this manner was positively charged at a voltage of 500 V, and an image was formed in the same manner as in Example 1. Thus, a clear, high-quality image could be obtained. The photoreceptor was repeatedly charged as in Example 1. As a result, reproducibility and stability of a transferred image were high, and resistance to corona, to humidity, and to wear was good.

EXAMPLE 4

An electrophotographic photoreceptor was manufactured following the same procedures as in Example 1 except that a barrier layer was formed as follows. More specifically, an $SiH_4$ gas with a flow rate of 500 SCCM, a $B_2H_6$ gas with a ratio of flow rate of $5\times10^{-2}$ with respect to the $SiH_4$ gas, and an $H_2$ gas with a flow rate of 500 SCCM were supplied to a reaction chamber, and the pressure of the interior of the reaction chamber was adjusted to 1 Torr. A high-frequency power of 13.56 MHz was applied to generate a plasma, thus forming a 100-Å thick p-type μc-Si:H thin layer on a drum substrate. Then, the flow rate of the $SiH_4$ gas was set to be 0, and an $N_2$ gas with a flow rate of 300 SCCM and the $B_2H_6$ gas with a ratio of flow rate of 10% with respect to the $N_2$ gas were supplied into the reaction chamber, and the pressure of the interior of the reaction chamber was adjusted to be 1.2 Torr. Thereafter, a high-frequency power of 600 W was applied to the reaction chamber to form a 50-Å thick a-BN thin layer. Upon repetition of the above operation, a 7,500-Å thick barrier layer constituted by 50 p-type μc-Si:H thin layers and 50 a-BN thin layers was formed.

The photoreceptor manufactured in this manner was positively charged at a voltage of 500 V, and an image was formed in the same manner as in Example 1. Thus, a clear, high-quality image could be obtained. The photoreceptor was repeatedly charged as in Example 1. As a result, reproducibility and stability of a transferred image were high, and resistance to corona, to humidity, and to wear was good.

EXAMPLE 5

An electrophotographic photoreceptor was manufactured following the same procedures as in Example 1 except that an i-type μc-Si layer was formed instead of the i-type a-Si:H layer. Note that the i-type μc-Si layer was obtained in such a manner that an $SiH_4$ gas with a flow rate of 100 SCCM and an $H_2$ gas with a flow rate of 1,200 SCCM were supplied into a reaction chamber, and a pressure inside the reaction chamber was set to be 1.2 Torr. Thereafter, a high-frequency power of 1 kW was applied.

The photoreceptor manufactured in this manner had high sensitivity with respect to light having a long wavelength of 780 to 790 nm corresponding to an oscillation wavelength of the semiconductor laser. The photoreceptor was mounted on a semiconductor laser printer, and an image was formed by the Carlson process. As a result, even if a light amount exposed to the photoreceptor surface was 25 ergcm$^2$, a clear, high-resolution image could be obtained.

When the photoreceptor was repeatedly charged, the reproducibility and stability of a transferred image were high, and resistance to corona, to humidity, and to wear was good.

EXAMPLE 6

An electrophotographic photoreceptor was manufactured following the same procedures as in Example 1 except that a barrier layer was formed as follows. More specifically, an $SiH_4$ gas with a flow rate of 500 SCCM and a $B_2H_6$ gas with a ratio of flow rate of $10^{-3}$ with respect to the $SiH_4$ gas were supplied into a reaction chamber, and the pressure of the interior of the reaction chamber was adjusted to 1 Torr. A high-frequency power of 13.56 MHz was then applied to generate a plasma, thus forming a 50-Å thick p-type a-Si:H thin layer on a drum substrate. Then, the flow rate of the $SiH_4$ gas was set to be 0, and an $N_2$ gas with a flow rate of 300 SCCM and the $B_2H_6$ gas at a ratio of flow rate of 10% with respect to the $N_2$ gas were supplied into the reaction chamber, and the pressure of the interior of the reaction chamber was adjusted to be 1.2 Torr. Thereafter, a high-frequency power of 600 W was applied to the reaction chamber to form a 50-Å thick a-BN thin layer. Upon repetition of the above operation, a 5,000-Å thick barrier layer constituted by 50 p-type a-Si:H thin layers and 50 a-BN thin layers was formed.

The photoreceptor manufactured in this manner was positively charged at a voltage of 500 V, and an image was formed in the same manner as in Example 1. Thus, a clear, high-quality image could be obtained. The photoreceptor was repeatedly charged as in Example 1. As a result, reproducibility and stability of a transferred image were high, and resistance to corona, to humidity, and to wear was good.

EXAMPLE 7

An electrophotographic photoreceptor was manufactured following the same procedures as in Example 6 except that an i-type μc-Si layer was formed instead of the i-type a-Si:H layer. Note that the i-type μc-Si layer was obtained in such a manner that an $SiH_4$ gas with a flow rate of 100 SCCM and an $H_2$ gas with a flow rate of 1,200 SCCM were supplied into a reaction chamber, and a pressure inside the reaction chamber was set to be 1.2 Torr. Thereafter, a high-frequency power of 1 kW was applied thereto.

The photoreceptor manufactured in this manner had high sensitivity with respect to light having a long wavelength of 780 to 790 nm corresponding to an oscillation wavelength of the semiconductor laser. The photoreceptor was mounted on a semiconductor laser printer, and an image was formed by the Carlson process. As a result, even if a light amount exposed to the photoreceptor surface was 25 ergcm$^2$, a clear, high-resolution image could be obtained.

When the photoreceptor was repeatedly charged, the reproducibility and stability of a transferred image were high, and resistance to corona, to humidity, and to wear was good.

EXAMPLE 8

An aluminum drum substrate having a diameter of 80 mm and a width of 350 mm and subjected to acid, alkali, and sandbrast treatments as needed to prevent interference was mounted in a reaction chamber, and the interior of the reaction chamber was evacuated to a vacuum of about $10^{-5}$ Torr. Thereafter, the drum substrate was heated to 250° C., and rotated at 10 rpm, and an $SiH_4$ gas with a flow rate of 300 SCCM was supplied into the reaction chamber, and the interior of the reaction chamber was adjusted to be 0.8 Torr. A high-frequency power of 100 W was applied to generate a plasma, and a 50-Å thick p-type a-Si thin layer was formed on the drum substrate. The dark resistance of this thin layer was $10^{10}$ Ω.cm. Then, an $SiH_4$ gas with a flow rate of 50 SCCM and a $CH_4$ gas with a flow rate of 250 SCCM were supplied into the reaction chamber, and a high-frequency power of 100 W was applied, thus forming a 50-Å thick a-SiC thin layer. The dark resistance of this thin layer was $10^{13}$ Ω.cm. The above operation was repeated, and a 5,000-A thick barrier layer having a hetero junction superlattice structure constituted by 50 each of two types of a-SiC thin layers having different dark resistances was formed.

An $SiH_4$ gas with a flow rate of 300 SCCM and a $B_2H_6$ gas with a ratio of flow rate of $1\times10^{-6}$ with respect to the $SiH_4$ gas were supplied into the reaction chamber, and the pressure of the interior of the reaction chamber was set to be 1.0 Torr. Thereafter, a high-frequency power of 200 W was applied to form a 25-μm thick photoconductive layer.

Finally, a 0.5-μm thick a-SiC surface layer was formed.

When a voltage of +6.5 kV was applied to the photoreceptor formed as described above, a surface potential of 500 V was obtained, and a charge-retaining ratio thereof after 5 seconds was 70%. Then, a voltage of −6.5 kV was applied to the photoreceptor. As a result, a surface potential of −400 V was obtained, and a charge-retaining ratio thereof after 5 seconds was 50%.

Furthermore, the photoreceptor was mounted on a copying machine, and an image was formed. In both cases of positive and negative charging, a clear, good image was obtained.

EXAMPLE 9

An electrophotographic photoreceptor was manufactured following the same procedures as in Example 8 except that an a-SiN thin layer was formed in place of the a-SiC thin layer as one constituting layer of the barrier layer. The dark resistance of the a-SiN thin layer was $10^{14}$ Ωcm.

Note that the a-SiN thin layer was obtained such that an $SiH_4$ gas with a flow rate of 25 SCCM and an $N_2$ gas with a flow rate of 500 SCCM were used, and a high-frequency power of 200 W was applied.

The photoreceptor was mounted on a copying machine and an image was formed as in Example 8. As a result, in both cases of positive and negative charging, a clear, good image was obtained.

EXAMPLE 10

An electrophotographic photoreceptor was manufactured following the same procedures as in Example 8 except that an a-SiGe thin layer was formed in place of the a-Si thin layer as one constituting layer of the barrier layer. The dark resistance of the a-SiGe thin layer was $18^8$ Ω.cm.

Note that the a-SiGe thin layer was obtained such that an $SiH_4$ gas with a flow rate of 300 SCCM and a Ge gas with a flow rate of 100 SCCM were used, and a high-frequency power of 300 W was applied.

The photoreceptor was mounted on a copying machine and an image was formed as in Example 8. As a result, in both cases of positive and negative charging, a clear, good image was obtained.

EXAMPLE 11

An aluminum drum substrate having a diameter of 80 mm and a width of 350 mm and subjected to acid, alkali, and sandbrast treatments as needed to prevent interference was mounted in a reaction chamber, and the interior of the reaction chamber was evacuated to a of about $10^{-5}$ Torr. Thereafter, the drum substrate was heated to 250° C., and rotated at 10 rpm, and an $SiH_4$ gas with a flow rate of 300 SCCM was supplied into the reaction chamber, so that the interior of the reaction chamber was adjusted to be 0.8 Torr. A high-frequency power of 100 W was applied to generate a plasma, and a 50-Å thick p-type a-Si thin layer was formed on the drum substrate. The optical band gap of this thin layer was 1.75 eV. Then, an $SiH_4$ gas with a flow rate of 50 SCCM and a $CH_4$ gas with a flow rate of 250 SCCM were supplied into the reaction chamber, and a high-frequency power of 100 W was applied, thus forming a 50-Å thick a-SiC thin layer. The band gap of the thin layer was 2.0 eV. The above operation was repeated, and a 5,000-Å thick barrier layer having a hetero superlattice structure constituted by 50 each of two types of a-SiC thin layers having different band gaps was formed.

An $SiH_4$ gas with a flow rate of 300 SCCM and a $B_2H_6$ gas with a ratio of flow rate of $1\times10^6$ with respect to the $SiH_4$ gas were supplied into the reaction chamber, and the pressure of the interior of the reaction chamber was set to be 1.0 Torr. Thereafter, a high-frequency power of 200 W was applied to form a 25-μm thick photoconductive layer.

Finally, a 0.5-μm thick a-SiC surface layer was formed.

When a voltage of +6.5 kV was applied to the photoreceptor formed as described above, a surface potential of 500 V was obtained, and a charge-retaining ratio thereof after 5 seconds was 70%. Then, a voltage of −6.5 kV was applied to the photoreceptor. As a result, a surface potential of −400 V was obtained, and a charge-retaining ratio thereof after 5 seconds was 50%.

Furthermore, the photoreceptor was mounted on a copying machine, and an image was formed. In both cases of positive and negative charging, a clear, good image was obtained.

EXAMPLE 12

An electrophotographic photoreceptor was manufactured following the same procedures as in Example 11 except that an a-SiN thin layer was formed in place of the a-SiC thin layer as one constituting layer of the barrier layer. The band gap of the a-SiN thin layer was 2.3 eV.

Note that the a-SiN thin layer was obtained such that an $SiH_4$ gas with a flow rate of 25 SCCM and an $N_2$ gas with a flow rate of 500 SCCM were used, and a high-frequency power of 200 W was applied.

The photoreceptor was mounted on a copying machine and an image was formed as in Example 11. As a result, in both cases of positive and negative charging, a clear, good image was obtained.

EXAMPLE 13

An electrophotographic photoreceptor was manufactured following the same procedures as in Example 11 except that an a-SiGe thin layer was formed in place of the a-Si thin layer as one constituting layer of the barrier layer. The band gap of the a-SiGe thin layer was 1.55 eV.

Note that the a-SiGe thin layer was obtained such that an $SiH_4$ gas with a flow rate of 300 SCCM and a Ge gas with a flow rate of 100 SCCM were used, and a high-frequency power of 300 W was applied.

The photoreceptor was mounted on a copying machine and an image was formed as in Example 8. As a result, in both cases of positive and negative charging, a clear, good image was obtained.

EXAMPLE 14

An aluminum drum substrate having a diameter of 80 mm and a width of 350 mm and subjected to acid, alkali, and sandbrast treatments as needed to prevent interference was mounted in a reaction chamber, and the interior of the reaction chamber was evacuated to a vacuum of about $10^{-5}$ Torr. Thereafter, the drum substrate was heated to 250° C., and rotated at 10 rpm, and an $SiH_4$ gas with a flow rate of 300 SCCM was supplied into the reaction chamber, and the interior of the reaction chamber was adjusted to be 0.8 Torr. A high-frequency power of 100 W was applied to generate a plasma, and a 50-Å thick p-type a-Si thin layer ($\rho d$: $10^{11}$ Ω.cm, $\rho p$: $10^{7}$ Ω.cm) was formed on the drum substrate. Then, an $SiH_4$ gas with a flow rate of 50 SCCM and a $CH_4$ gas with a flow rate of 250 SCCM were supplied into the reaction chamber, and a high-frequency power of 100 W was applied, thus forming a 50-Å thick a-SiC thin layer ($\rho d$: up to $10^{13}$ Ω.cm, $\rho p$: up to $10^{13}$ Ω.cm). The above operation was repeated, and a 5,000-Å thick barrier layer having a hetero junction superlattice structure constituted by 50 each of two types of a-SiC thin layers was formed.

An $SiH_4$ gas with a flow rate of 300 SCCM and a $B_2H_6$ gas with a ratio of flow rate of $1\times10^{-6}$ with respect to the $SiH_4$ gas were supplied into the reaction chamber, so that the pressure of the interior of the reaction chamber was set to be 1.0 Torr. Thereafter, a high-frequency power of 200 W was applied to form a 25-μm thick photoconductive layer.

Finally, a 0.5-μm thick a-SiC surface layer was formed.

When a voltage of +6.5 kV was applied to the photoreceptor formed as described above, a surface potential of 500 V was obtained, and a charge-retaining ratio thereof after 5 seconds was 70%. Then, a voltage of −6.5 kV was applied to the photoreceptor. As a result, a surface potential of −400 V was obtained, and a charge-retaining ratio thereof after 5 seconds was 50%.

Furthermore, the photoreceptor was mounted on a copying machine, and an image was formed. In both cases of positive and negative charging, a clear, good image was obtained.

EXAMPLE 15

An electrophotographic photoreceptor was manufactured following the same procedures as in Example 14 except that an a-SiN thin layer ($\rho d$, $\rho p$: up to $10^{14}$ Ω.cm) was formed in place of the a-SiC thin layer as one constituting layer of the barrier layer.

Note that the a-SiN thin layer was obtained such that an $SiH_4$ gas with a flow rate of 25 SCCM and an $N_2$ gas with a flow rate of 500 SCCM were used, and a high-frequency power of 200 W was applied.

The photoreceptor was mounted on a copying machine and an image was formed as in Example 14. As a result, in both cases of positive and negative charging, a clear, good image was obtained.

EXAMPLE 16

An electrophotographic photoreceptor was manufactured following the same procedures as in Example 14 except that an a-BN thin layer ($\rho d$, $\rho p$: up to $10^{14}$ Ω.cm) was formed in place of the a-SiC thin layer as one constituting layer of the barrier layer.

Note that the a-BN thin layer was obtained such that an $N_2$-diluted $B_2H_6$ gas with a flow rate of 200 SCCM was supplied, and a high-frequency power of 400 W was applied.

The photoreceptor was mounted on a copying machine and an image was formed as in Example 14. As a result, in both cases of positive and negative charging, a clear, good image was obtained.

EXAMPLE 17

A 7,500-Å barrier layer having a hetero junction superlattice structure was formed following the same procedures as in Example 14 except that a 100-Å μc-Si thin layer ($\rho d$: $10^{10}$ Ω.cm, $\rho p$: $10^{7}$ Ω.cm) was formed in place of the 50-Å thick a-Si thin layer as one constituting layer of the barrier layer.

Note that the μc-Si thin layer was obtained such that an $SiH_4$ gas with a flow rate of 25 SCCM and an $H_2$ gas with a flow rate of 500 SCCM were supplied, and a high-frequency power of 500 W was applied.

The photoreceptor was mounted on a copying machine and an image was formed as in Example 14. As a result, in both cases of positive and negative charging, a clear, good image was obtained.

The types of thin layers were not limited to two as in the above examples. Three types or more of thin layers may be stacked. That is, a combination of thin layers having different band gaps need only be employed.

What is claimed is:

1. An electrophotographic receptor comprising a conductive substrate, a barrier layer formed thereon, and a photoconductive layer formed on said barrier layer for generating photocarriers upon radiation of light, wherein said barrier layer has a portion formed by alternately stacked first thin layers comprising amorphous silicon containing at least one element belonging to Group III or V of the Periodic Table, and second thin layers comprising amorphous boron nitride, said first and second thin layers forming a superlattice structure, wherein said second thin layers have a band gap wider than that of said first thin layers.

* * * * *